US006443702B1

(12) United States Patent
Ross

(10) Patent No.: US 6,443,702 B1
(45) Date of Patent: Sep. 3, 2002

(54) MOTORIZED CEILING FAN LIFTING AND LOWERING APPARATUS

(76) Inventor: Curtis O. Ross, 1658 Ruth St., Cocoa, FL (US) 32926

( * ) Notice: Subject to any disclaimer, the term of this patent is extended or adjusted under 35 U.S.C. 154(b) by 0 days.

(21) Appl. No.: 09/751,744

(22) Filed: Dec. 29, 2000

(51) Int. Cl.[7] ..... F04D 29/64
(52) U.S. Cl. ..... 416/246; 248/333
(58) Field of Search ..... 248/232, 333; 416/210 R, 5, 244 R, 246; 362/386

(56) References Cited

U.S. PATENT DOCUMENTS 1,815,074 A * 7/1931 Schaefer ..... 248/333
2,592,315 A * 4/1952 Mosley ..... 248/333
5,090,654 A 2/1992 Ridings et al.
5,105,349 A 4/1992 Falls et al.
5,154,579 A 10/1992 Rezek
5,273,402 A 12/1993 Maury
5,556,195 A 9/1996 Glebe
5,615,855 A * 4/1997 Marue et al. ..... 248/405
D386,257 S 11/1997 Liu

* cited by examiner

*Primary Examiner*—F. Daniel Lopez
*Assistant Examiner*—Dwayne J White

(57) ABSTRACT

A motorized ceiling fan lifting and lowering apparatus for lowering a ceiling fan so that the ceiling fan may be easily cleaned. The motorized ceiling fan lifting and lowering apparatus includes a tubular member, which is elongated and has a first end and a second end. The first end is open. A shoulder is integrally coupled to an edge of the first end and extends inwardly. A lip extends upwardly from the shoulder. The lip has a threaded inner surface. The second end of the tubular member is coupled to a ceiling fan. A motor is attached to the ceiling. A shaft has a first end attached to the motor such that the motor may selectively rotate the shaft in a first direction or a second direction. The shaft is threaded and has a second end extending through the lip and into the tubular member such that the shaft threadably engages the lip. An actuator selectively actuates the motor in the first or second direction for lowering and lifting the ceiling fan. The actuator is electrically coupled to the motor.

6 Claims, 2 Drawing Sheets

MOTORIZED CEILING FAN LIFTING AND LOWERING APPARATUS

BACKGROUND OF THE INVENTION

1. Field of the Invention

The present invention relates to ceiling fan lowering devices and more particularly pertains to a new motorized ceiling fan lifting and lowering apparatus for lowering a ceiling fan so that the ceiling fan may be easily cleaned.

2. Description of the Prior Art

The use of ceiling fan lowering devices is known in the prior art. More specifically, ceiling fan lowering devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,105,349; U.S. Pat. No. 5,090,654; U.S. Pat. No. 5,556,195; U.S. Pat. No. 5,154,579; U.S. Des. Pat. No. 386,257; and U.S. Pat. No. 5,273,402.

While these devices fulfill their respective, particular objectives and requirements, the aforementioned patents do not disclose a new motorized ceiling fan lifting and lowering apparatus. The inventive device includes a tubular member, which is elongated and has a first end and a second end. The first end is open. A shoulder is integrally coupled to an edge of the first end and extends inwardly. A lip extends upwardly from the shoulder. The lip has a threaded inner surface. The second end of the tubular member is coupled to a ceiling fan. A motor is attached to the ceiling. A shaft has a first end attached to the motor such that the motor may selectively rotate the shaft in a first direction or a second direction. The shaft is threaded and has a second end extending through the lip and into the tubular member such that the shaft threadably engages the lip. An actuator selectively actuates the motor in the first or second direction for lowering and lifting the ceiling fan. The actuator is electrically coupled to the motor.

In these respects, the motorized ceiling fan lifting and lowering apparatus according to the present invention substantially departs from the conventional concepts and designs of the prior art, and in so doing provides an apparatus primarily developed for the purpose of lowering a ceiling fan so that the ceiling fan may be easily cleaned.

SUMMARY OF THE INVENTION

In view of the foregoing disadvantages inherent in the known types of ceiling fan lowering devices now present in the prior art, the present invention provides a new motorized ceiling fan lifting and lowering apparatus construction wherein the same can be utilized for lowering a ceiling fan so that the ceiling fan may be easily cleaned.

The general purpose of the present invention, which will be described subsequently in greater detail, is to provide a new motorized ceiling fan lifting and lowering apparatus apparatus and method which has many of the advantages of the ceiling fan lowering devices mentioned heretofore and many novel features that result in a new motorized ceiling fan lifting and lowering apparatus which is not anticipated, rendered obvious, suggested, or even implied by any of the prior art ceiling fan lowering devices, either alone or in any combination thereof.

To attain this, the present invention generally comprises a tubular member, which is elongated and has a first end and a second end. The first end is open. A shoulder is integrally coupled to an edge of the first end and extends inwardly. A lip extends upwardly from the shoulder. The lip has a threaded inner surface. The second end of the tubular member is coupled to a ceiling fan. A motor is attached to the ceiling. A shaft has a first end attached to the motor such that the motor may selectively rotate the shaft in a first direction or a second direction. The shaft is threaded and has a second end extending through the lip and into the tubular member such that the shaft threadably engages the lip. An actuator selectively actuates the motor in the first or second direction for lowering and lifting the ceiling fan. The actuator is electrically coupled to the motor.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new motorized ceiling fan lifting and lowering apparatus apparatus and method which has many of the advantages of the ceiling fan lowering devices mentioned heretofore and many novel features that result in a new motorized ceiling fan lifting and lowering apparatus which is not anticipated, rendered obvious, suggested, or even implied by any of the prior art ceiling fan lowering devices, either alone or in any combination thereof.

It is another object of the present invention to provide a new motorized ceiling fan lifting and lowering apparatus which may be easily and efficiently manufactured and marketed.

It is a further object of the present invention to provide a new motorized ceiling fan lifting and lowering apparatus which is of a durable and reliable construction.

An even further object of the present invention is to provide a new motorized ceiling fan lifting and lowering apparatus which is susceptible of a low cost of manufacture with regard to both materials and labor, and which accordingly is then susceptible of low prices of sale to the consuming public, thereby making such motorized ceiling fan lifting and lowering apparatus economically available to the buying public.

Still yet another object of the present invention is to provide a new motorized ceiling fan lifting and lowering apparatus which provides in the apparatuses and methods of the prior art some of the advantages thereof, while simultaneously overcoming some of the disadvantages normally associated therewith.

Still another object of the present invention is to provide a new motorized ceiling fan lifting and lowering apparatus for lowering a ceiling fan so that the ceiling fan may be easily cleaned.

Yet another object of the present invention is to provide a new motorized ceiling fan lifting and lowering apparatus which includes a tubular member, which is elongated and has a first end and a second end. The first end is open. A shoulder is integrally coupled to an edge of the first end and extends inwardly. A lip extends upwardly from the shoulder. The lip has a threaded inner surface. The second end of the tubular member is coupled to a ceiling fan. A motor is attached to the ceiling. A shaft has a first end attached to the motor such that the motor may selectively rotate the shaft in a first direction or a second direction. The shaft is threaded and has a second end extending through the lip and into the tubular member such that the shaft threadably engages the lip. An actuator selectively actuates the motor in the first or second direction for lowering and lifting the ceiling fan. The actuator is electrically coupled to the motor.

Still yet another object of the present invention is to provide a new motorized ceiling fan lifting and lowering apparatus that may be retrofitted to existing ceiling fans or may be constructed in combination with a ceiling fan.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
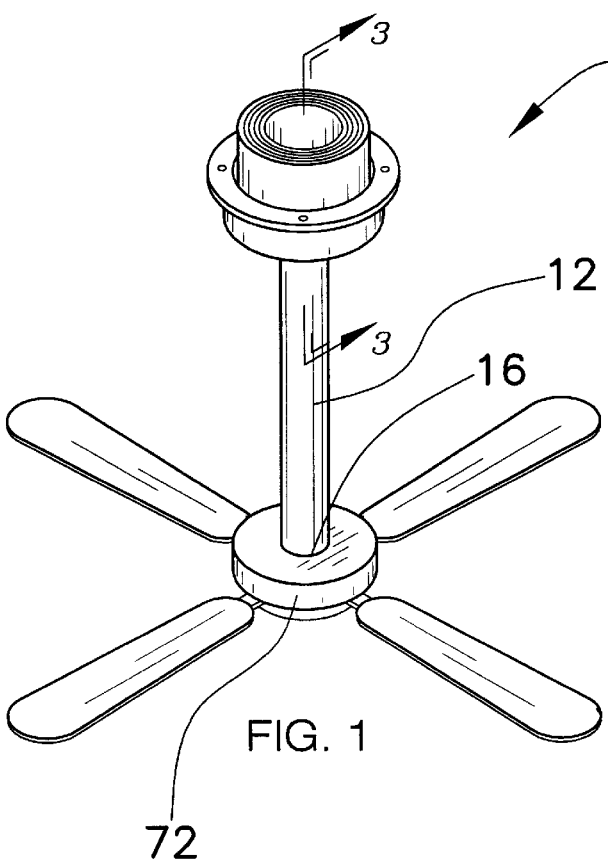
FIG. 1 is a schematic perspective view of a new motorized ceiling fan lifting and lowering apparatus according to the present invention.

With reference now to the drawings, and in particular to FIGS. 1 through 5 thereof, a new motorized ceiling fan lifting and lowering apparatus embodying the principles and concepts of the present invention and generally designated by the reference numeral 10 will be described.

As best illustrated in FIGS. 1 through 5, the motorized ceiling fan lifting and lowering apparatus 10 generally comprises a device that is attachable to a ceiling 70 and securely coupled to a ceiling fan 72. The device includes a tubular member 12 which is elongated and has a first end 14 and a second end 16. The first end 14 is open. A shoulder 18 is integrally coupled to an edge of the first end 14 and extends inwardly. A lip 20 extends upwardly from the shoulder. The lip 20 has a threaded inner surface 22. The second end 16 of the tubular member 12 is coupled to the ceiling fan 72.

A motor 24 is attached to the ceiling 70. The motor 24 ideally comprises an electric motor. The motor 24 may be positioned on the inner surface or the outer surface of the ceiling 70. Also, the motor 24 may be coupled to ceiling studs 74. The motor 24 is preferably hard wired to the electrical circuitry of the dwelling.

A shaft 26 has a first end 28 attached to the motor 24 such that the motor 24 may selectively rotate the shaft 26 in a first direction or a second direction. The shaft 26 is threaded. The shaft 26 has a second end 30 extending into through the lip 20 and into the tubular member 12 such that the shaft 26 threadably engages the lip 20. A plate 32 is securely attached to the second end 30 of the shaft 26. The plate 32 has a width greater than a width of an opening through the lip 20 so that the shaft 26 may not be fully removed from the tubular member 12. The shaft 26 preferably has a length generally between 2 feet and 4 feet.

An actuator 34 selectively actuates the motor 24 in the first or second direction. The actuator 34 is electrically coupled to the motor.

Figure 2:
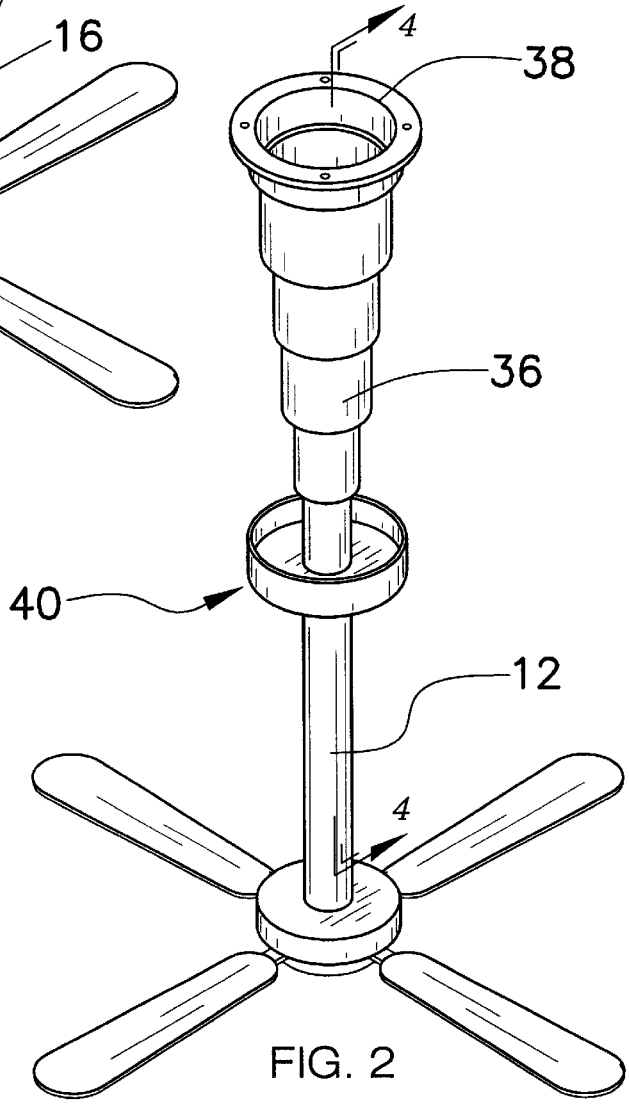
FIG. 2 is a schematic perspective view of the present invention.
Figure 3:
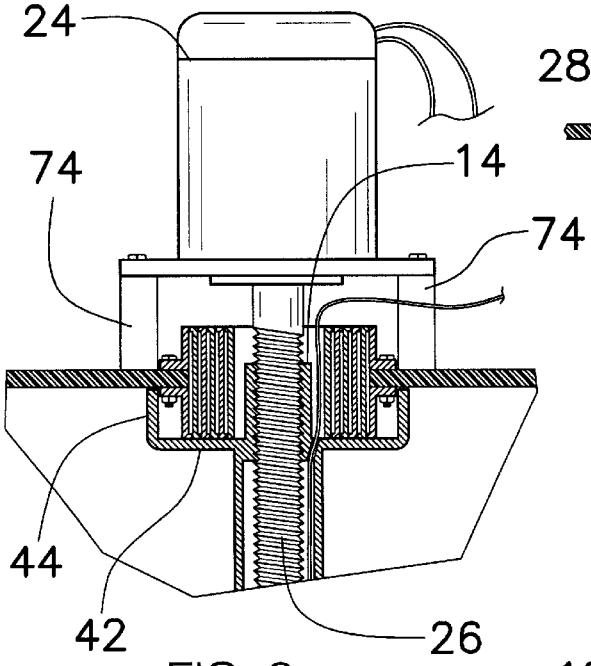
FIG. 3 is a schematic cross-sectional view taken along line 3—3 of the present invention.
Figure 4:
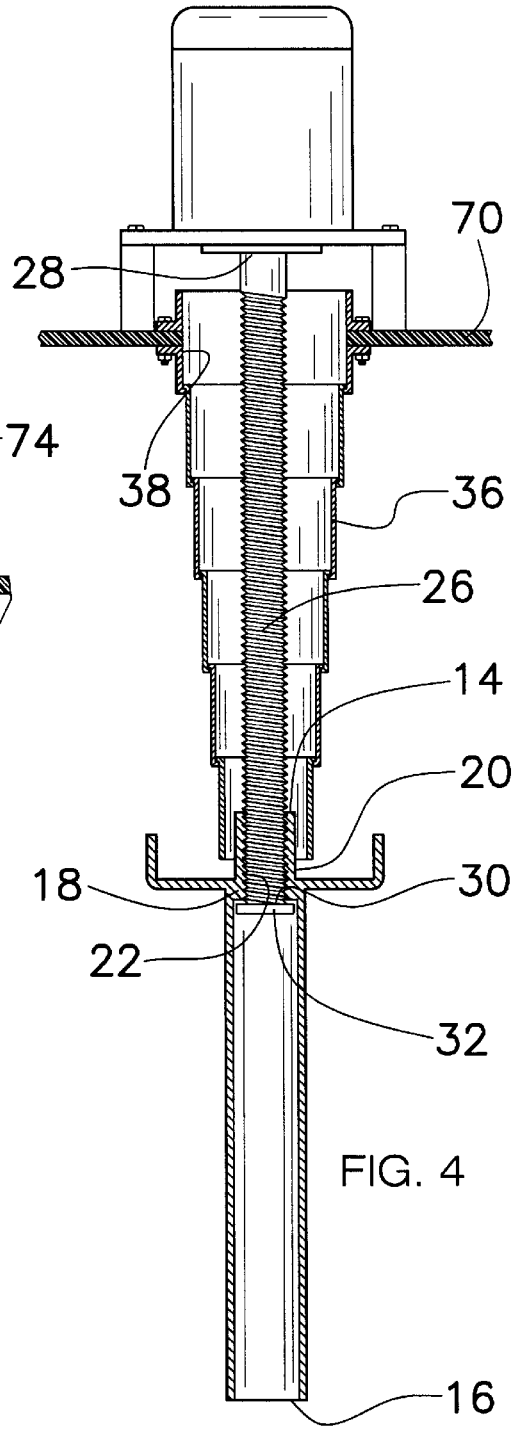
FIG. 4 is a schematic cross-sectional view taken along line 4—4 of the present invention.
Figure 5:
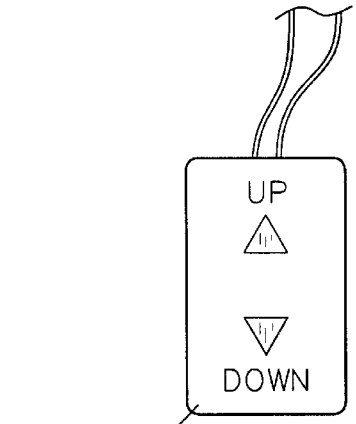
FIG. 5 is a schematic plan view of an actuator of the present invention.

A cover member 36 for covering the shaft comprises a pipe. The shaft 26 extends through the pipe. A first end 38 of the pipe, or cover member 36, is removably attached to the ceiling 70, and the pipe is telescoping. Preferably, the pipe 36 has a length generally equal to a length of the shaft 26. As the tubular member 12 is lowered, gravity extends the pipe 38, as shown in FIGS. 2 and 4, so that it covers the shaft 26.

A housing 40 includes a flange 42 integrally coupled to and extending away from the first end 14 of the tubular member 12. A perimeter wall 44 is integrally coupled to a free edge of the flange 42 and extends upwardly away therefrom. The flange 42 has a width greater than a width of the cover member 36. The housing 40 may substantially enclose the cover member 36 between the flange 42 and the ceiling 70 when the perimeter wall 44 is abutting the ceiling 70.

In use, the motor 24 rotates the shaft 26 in a first direction so that tubular member 12 is lowered, which, in turn, lowers the ceiling fan 72 to a reachable level. The ceiling fan 72 may then be cleaned. Once the cleaning is finished, the motor 24 is used to rotate the shaft 26 in a second direction so that the tubular member 12, along with the ceiling fan 72, is lifted.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A motorized ceiling fan lowering device, said device being attachable to a ceiling and securely coupled to a ceiling fan, said device comprising:

a tubular member, said tubular member being elongated and having a first end and a second end, said first end being open, a shoulder being integrally coupled to an edge of said first end and extending inwardly, a lip extending upwardly from said shoulder, said lip having a threaded inner surface, said second end of said tubular member being coupled to said ceiling fan;

a motor, said motor being attached to said ceiling, said motor comprising an electric motor;

a shaft having a first end being attached to said motor such that said motor may selectively rotate said shaft in a first direction or a second direction, said shaft being threaded, said shaft having a second end extending through said lip and into said tubular member such that said shaft threadably engages said lip; and an actuator for selectively actuating said motor in said first or second direction, said actuator being electrically coupled to said motor.

2. The motorized ceiling fan lowering device as in claim 1, further including:

a plate being securely attached to said second end of said shaft, said plate having a width greater than a width of an opening through said lip.

3. The motorized ceiling fan lowering device as in claim 1, further including:

a cover member for covering said shaft, said cover member comprising a pipe, said shaft extending through said pipe, a first end of said pipe being removably attached to said ceiling, said pipe being telescoping.

4. The motorized ceiling fan lowering device as in claim 3, further including:

a housing comprising a flange being integrally coupled to and extending away from said first end of said tubular member, a perimeter wall being integrally coupled to a free edge of said flange and extending upwardly away therefrom, said flange having a width greater than a width of said cover member, wherein said housing may substantially enclose said cover member between said flange and said ceiling when said perimeter wall is abutting said ceiling.

5. The motorized ceiling fan lowering device as in claim 3, further including:

a housing comprising a flange being integrally coupled to and extending away from said first end of said tubular member, a perimeter wall being integrally coupled to a free edge of said flange and extending upwardly away therefrom.

6. A motorized ceiling fan lowering device, said device being attachable to a ceiling and securely coupled to a ceiling fan, said device comprising:

a tubular member, said tubular member being elongated and having a first end and a second end, said first end being open, a shoulder being integrally coupled to an edge of said first end and extending inwardly, a lip extending upwardly from said shoulder, said lip having a threaded inner surface, said second end of said tubular member being coupled to said ceiling fan;

a motor, said motor being attached to said ceiling, said motor comprising an electric motor;

a shaft having a first end being attached to said motor such that said motor may selectively rotate said shaft in a first direction or a second direction, said shaft being threaded, said shaft having a second end extending through said lip and into said tubular member such that said shaft threadably engages said lip, a plate being securely attached to said second end of said shaft, said plate having a width greater than a width of an opening through said lip, said shaft having a length generally between 2 feet and 4 feet;

an actuator for selectively actuating said motor in said first or second direction, said actuator being electrically coupled to said motor;

a cover member for covering said shaft, said cover member comprising a pipe, said shaft extending through said pipe, a first end of said pipe being removably attached to said ceiling, said pipe being telescoping, said pipe having a length generally equal to a length of said shaft; and a housing comprising a flange being integrally coupled to and extending away from said first end of said tubular member, a perimeter wall being integrally coupled to a free edge of said flange and extending upwardly away therefrom, said flange having a width greater than a width of said cover member, wherein said housing may substantially enclose said cover member between said flange and said ceiling when said perimeter wall is abutting said ceiling.

* * * * *